United States Patent [19]

Fay

[11] 4,363,694

[45] Dec. 14, 1982

[54] BONDED FABRIC MACHINE

[75] Inventor: Robert C. Fay, Spartanburg, S.C.

[73] Assignee: Milliken Research Corporation, Spartanburg, S.C.

[21] Appl. No.: 350,515

[22] Filed: Feb. 19, 1982

Related U.S. Application Data

[63] Continuation of Ser. No. 186,895, Sep, 15, 1980, abandoned.

[51] Int. Cl.[3] ..... D04H 11/00

[52] U.S. Cl. ..... 156/435; 156/72

[58] Field of Search ..... 156/72, 435

[56] References Cited

U.S. PATENT DOCUMENTS

| | | | |
|---|---|---|---|
| 2,101,905 | 12/1937 | Hopkinson | 156/435 |
| 3,127,293 | 3/1964 | Trenteseaux | 156/72 |
| 3,790,426 | 2/1974 | Bylund | 156/72 |

*Primary Examiner*—Michael W. Ball

*Attorney, Agent, or Firm*—Earle R. Marden; H. William Petry

[57] ABSTRACT

A bonded fabric producing machine in which the yarn is implanted in zig-zag fashion into coated substrates by a pair of folding blades which folds the yarn between the substrates fed between vertical guides. The machine is adapted to allow ready adjustment of the position of the folding blades when the distance between the vertical guides is adjusted.

3 Claims, 9 Drawing Figures

BONDED FABRIC MACHINE

This is a continuation of application Ser. No. 186,895, filed Sept. 15, 1980, now abandoned.

This application relates to a process and apparatus for manufacturing fabrics with non-woven pile such as carpets or velvets, according to which one coats, on one side only, two continuous support bands with a layer of adhesive; one displaces these support bands in a passage in which they lie practically parallel to one another at a predetermined distance from one another in such a way that the adhesive layer carried by one of the support bands faces that carried by the other support band; one drives at least one continuous element in the form of a thread or band by folder blades, alternately against the adhesive layers carried by the support bands when they are displaced at the entrance to the above-mentioned passage or in the neighborhood thereof, in such a way as to apply the continuous element alternatively against these adhesive layers and to fold it zig-zag; one ensures the hold by at least one of the adhesive layers and one then separates the support bands from one another.

It is therefore an object of the invention to provide a process and apparatus which economically and efficiently manufactures a non-woven pile fabric.

Other objects and advantages of the invention will become readily apparent as the specification proceeds to describe the invention with reference to the accompanying drawings, in which.

Figure 1:
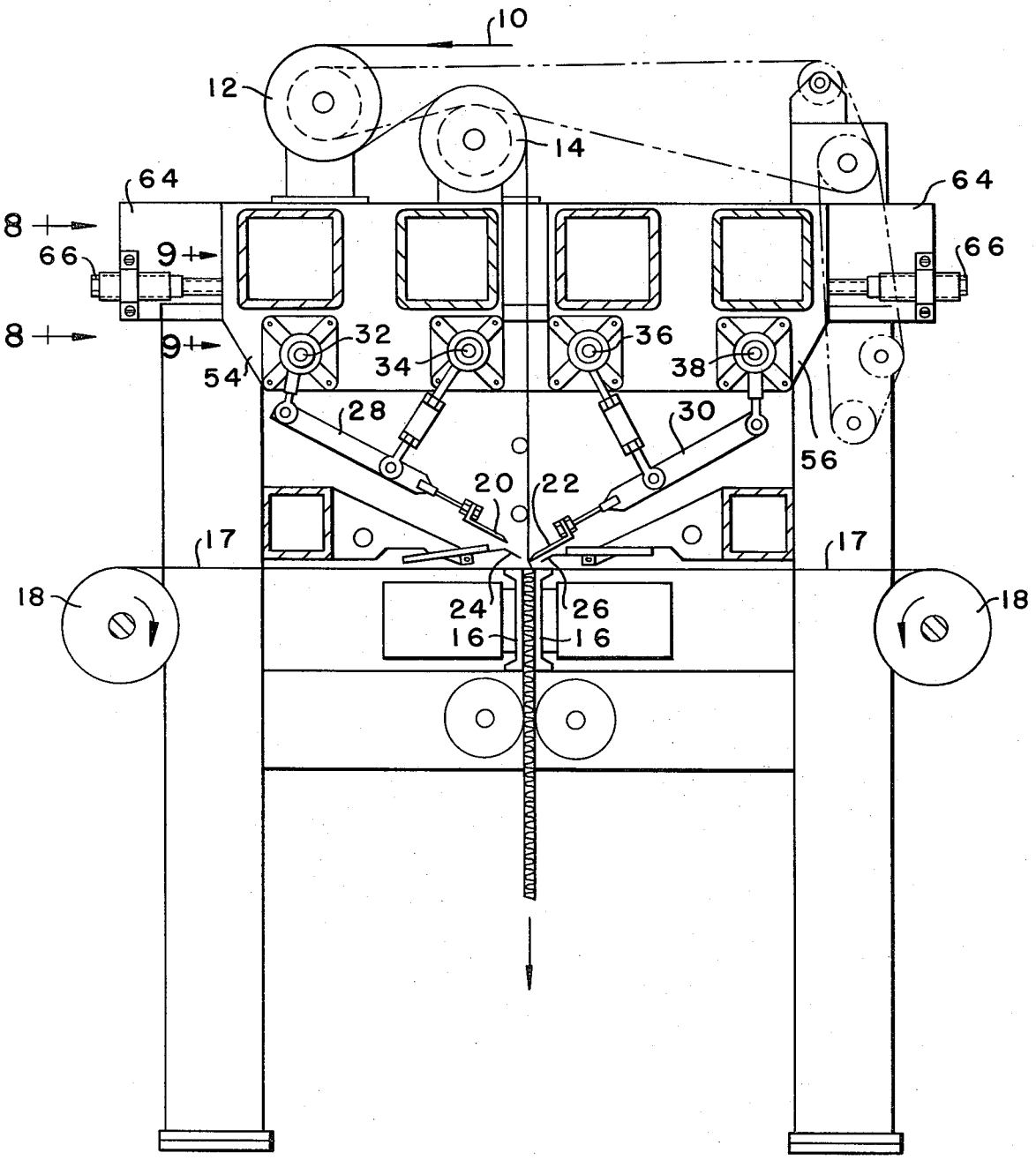
FIG. 1 is an elevation view of the new and improved apparatus taken on line 1—1 of FIG. 2.
Figure 2:
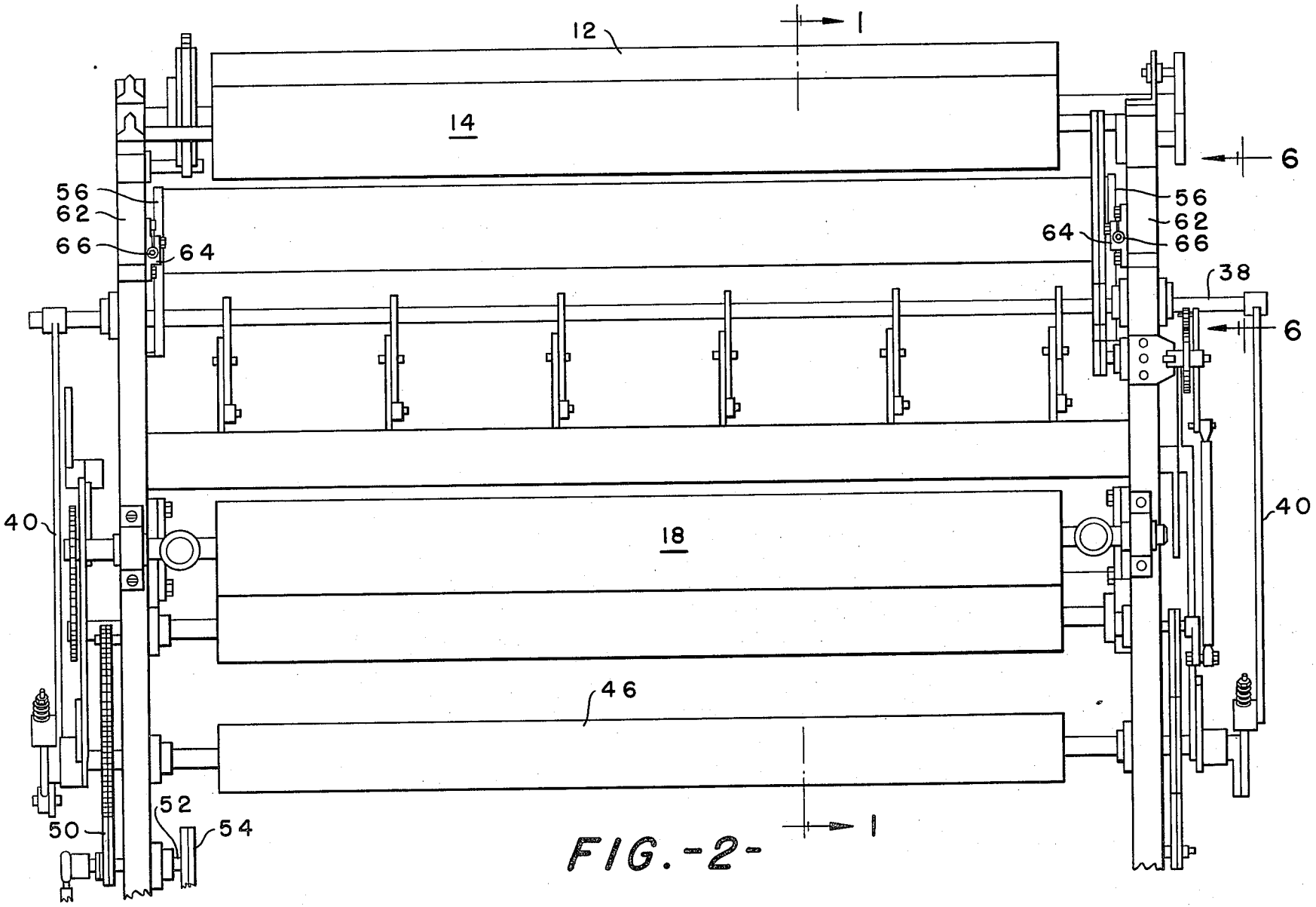
FIG. 2 is a left hand elevation view of the apparatus shown in FIG. 1.

Looking now to FIGS. 1 and 2, the basic operation of the apparatus will be explained. Carpet yarn 10 is supplied from a yarn source (not shown) over and around guide rolls 12 and 14 and down to the vertical guides 16. Carpet backing 17 is supplied from rolls 18 into position between the guides 16. During the path of travel from the rolls to the guides 16 an adhesive is applied to the top surface of the carpet backing 17 to secure yarn placed thereagainst by the folding blades 20 and 22. As the yarn 10 enters between the vertical guides 16 and folding blades 20 and 22 alternately displace the yarn in a zig-zag fashion into one or the other of the carpet backing sheets 17 as the carpet backing is being drawn downwardly. Then the carpet backing with the yarn therebetween is heated to cure the adhesive to form a good bond between the backing 17 and the yarn 10. Then the yarn 10 is severed in the middle of the backing sheets 17 by any suitable means to provide, simultaneously, two sheets of carpet.

The folding of the yarn 10 in zig-zag fashion is basically accomplished by the folding blades 20 and 22 and the pivotally mounted bladelets 24 and 26. Folding blades 20 and 22 are mounted, respectively, to connecting rods 28 and 30. Connecting rod 28 is pivotally connected to pivot shafts 32 and 34 and connecting rod 30 is pivotally connected to pivot shafts 36 and 38 through suitable links (not shown). The shafts 32 and 38 are oscillated by an oscillating crank arm mechanism (not shown). The main drive shafts are driven through a chain member 50 driven by a sprocket (not shown) on the stub shaft 52 which is in turn driven by a belt 54 connected to the main drive motor (not shown). It should be noted that the blade 20 is out of phase with the blade 22 so that when the blade 22 is being pivoted inwardly as shown in FIG. 1, the blade 20 is being pivoted outwardly and vice versa.

Figure 3:
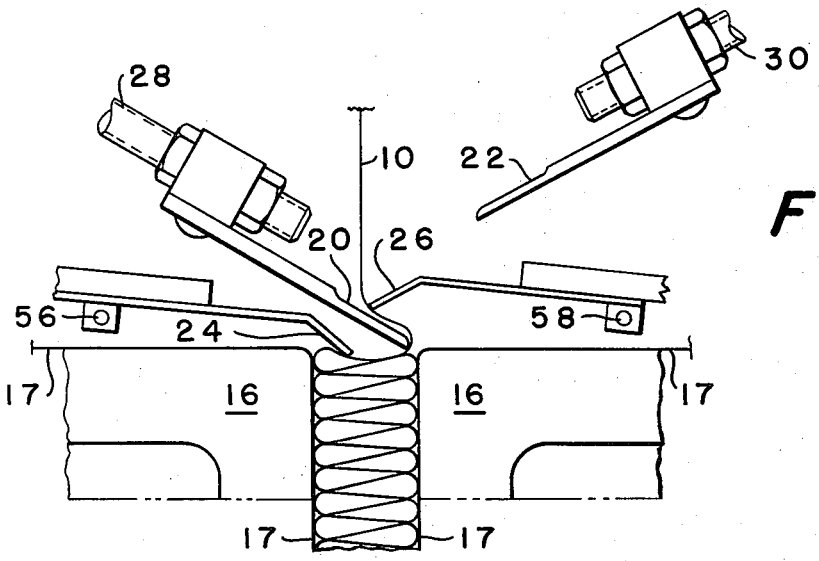
FIGS. 3–5 illustrate the operation of the folding blades.
Figure 4:
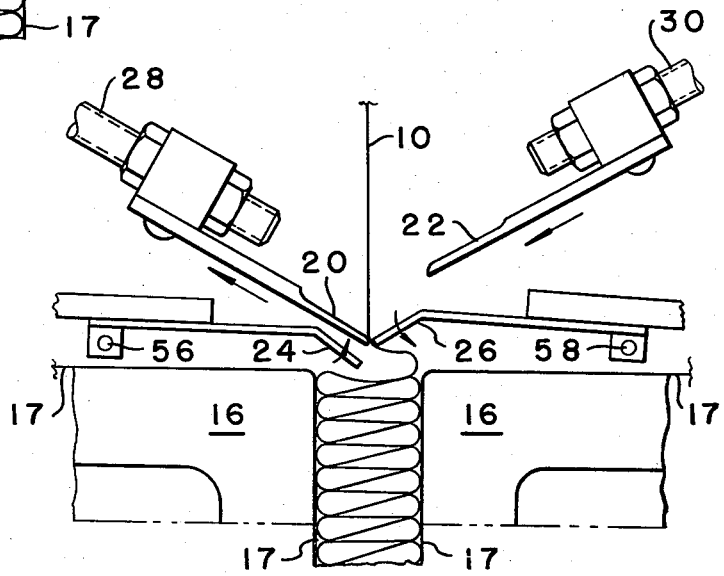
Figure 5:
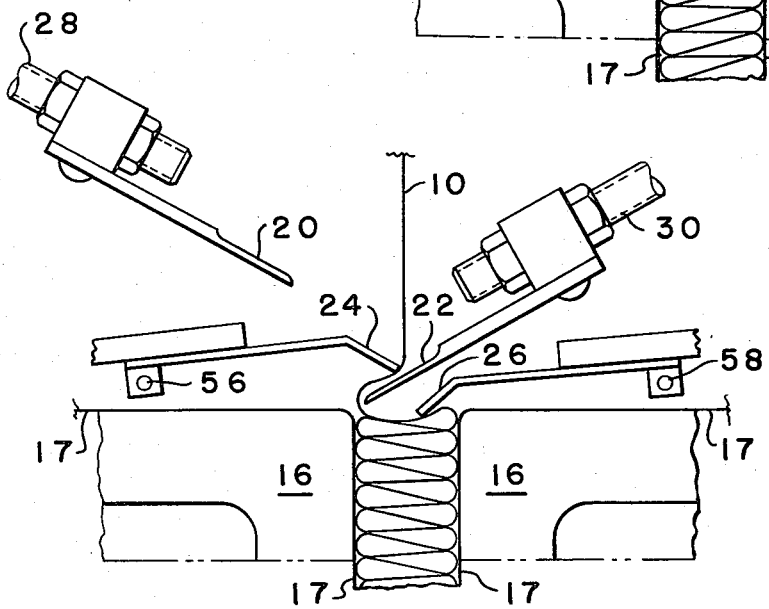
Figure 6:
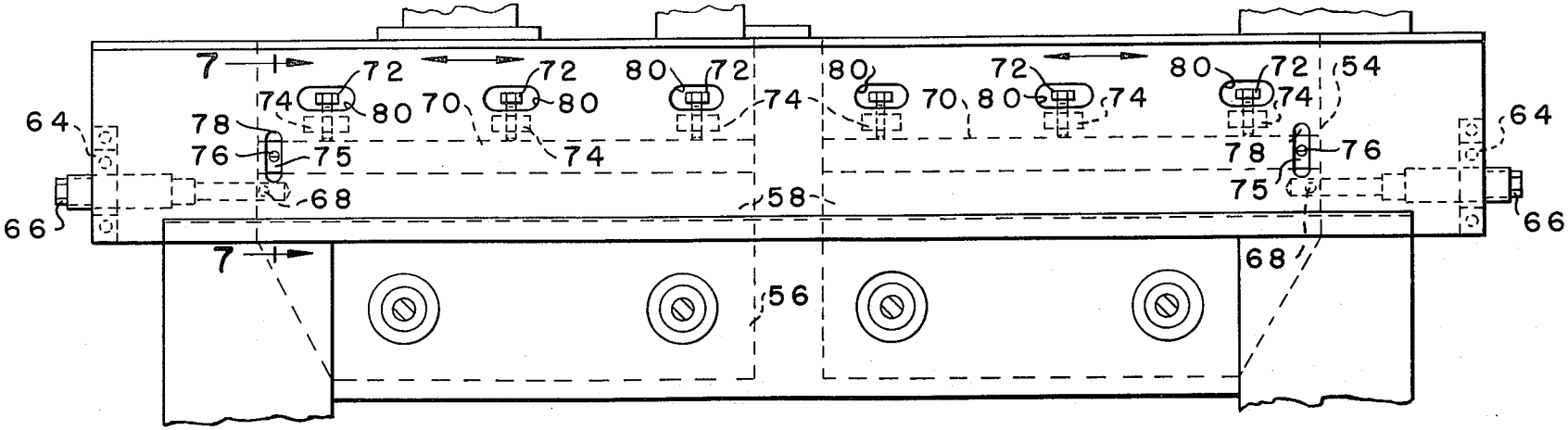
FIG. 6 is an end view taken on line 6—6 of FIG. 2.
Figure 9:
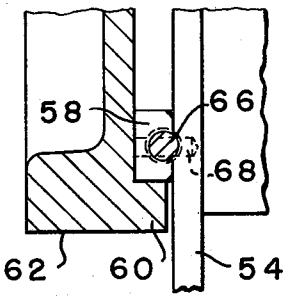
FIG. 9 is a section view taken on line 9—9 of FIG. 1.
Figure 8:
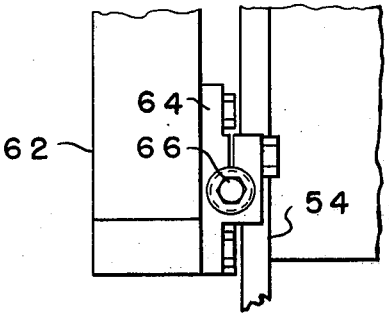
FIG. 8 is an end view taken on line 8—8 of FIG. 1.
Figure 7:
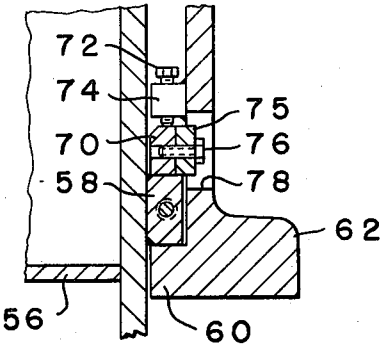
FIG. 7 is a partial section view taken on line 7—7 of FIG. 6.

The folding blades operate out of phase with one another to provide the zig-zag configuration of the yarn between the carpet backing sheets 17. In FIG. 3, folding blade 20 is being pivoted to its extreme in position where it will press the yarn into the adhesive on the carpet backing while folding blade 22 is being pivoted to its extreme out position. At the same time bladelet 24 is pivoted to its down position bearing on the yarn 10 while bladelet 26 is pivoting forward to start to pre-fold the yarn 10 for the formation of the next loop. In FIG. 4 the blade 20 is now being pivoted away from the yarn embedded in the adhesive and the blade 22 is being pivoted forward to contact the yarn 10 above the bladelet 26. At the same time the bladelet 24 is being pivoted out of the way while bladelet 26 is being pivoted downwardly to complete the pre-fold in the yarn. Then the blade 22 continues forward as in FIG. 5 to place the pre-folded yarn 10 into the adhesive on the opposite carpet backing as the blade 20 is pivoted to its rear position. At the same time bladelet 24 is pivoting downwardly to the pre-fold position for the next successive loop while the other bladelet is down on top of the previously formed loop. Then in zig-zag fashion the folding blades and bladelets repeat the above operation to form loops on one carpet backing 17 and then on the other.

When it is desired to widen or narrow the gap between the guides 16 to increase or decrease the length of the yarn folds to provide a change in the pile heighth of the fabric produced, it is also necessary to individually adjust the position of all the linkages of the folding blades 20 and 22. To eliminate this problem the arrangement shown in detail in FIGS. 6–9 is employed to allow a simple adjustment which automatically adjusts the position of the blades.

To accomplish the above, the main supports 54 and 56 for the folding blades each have a sliding block 58, welded or otherwise secured thereto, which engages the flange portion 60 on the inside of the frame supports 62. Mounted on the frame supports 62 on the front and back of the machine is a screw support 64 through which is mounted a screw 66. At the inside end of each screw 66 is a pin 68 which engages the sliding block 58 and the main supports 54 and 56 so that when the screw 66 is rotated in the screw support 64, both the sliding block 58 and the folding blade main supports 54 and 56 will be slid on the flange portion 60. To lock the sliding block 58 in a desired position a clamp block 70 is mounted on top of each sliding block 58 and clamped against the sliding block 58 by a plurality of screws 72. The screws 72 are screwed through a support block 74 welded or otherwise secured to the frame supports 62. To maintain the clamp block in position when the slide block 58 is being slid key members 75 are secured to the side of the clamp block by suitable screws 76 and project through an elliptical groove 78 in the frame member 62. Also provided are a plurality of elliptical openings 80 in each of the frame members 62 to allow ready access to the screws 72.

OPERATION

When it is desired to change the heighth of the pile of the fabric being produced, the spacing between the guides 16 is adjusted to provide the desired pile heighth. The amount of adjustment is noted and the screws 72 are loosened to allow the sliding movement of the slide block 58. The screws 66 are adjusted an amount corresponding to the adjustment of the gap between the guides 16 to automatically adjust the spacing between the folding blades 20 and 22. Then when the blade adjustment has been completed, the screws 72 are screwed downward against the clamp block 70 to prevent the further movement of the slide block 58. Thusly, the spacing between the blades 20 and 22 can be readily adjusted to match the change in the horizontal distance between the vertical guide members 16.

Although the preferred embodiment of the invention has been described, it is contemplated that changes may be made without departing from the scope or spirit of the invention and I desire to be limited only by the scope of the claims.

I claim:

1. Apparatus to produce a bonded fabric comprising: a frame, means to supply two adhesive coated backing sheets operably associated with said frame, means to guide the backing material into opposed relationship, said means to guide including a pair of opposed, adjustable spaced guide members, a pair of folding blades, means to supply a plurality of yarns between said folding blades, means operably associated with said folding blades to alternately cause said folding blades to place yarn into the adhesive on one of said backing sheets between said spaced guide members and then into the other backing sheet, each of said folding blades being operably connected to a support member separated from said spaced guide members and from the support member of the other of said folding blades, support means slidably supporting each of said support members to said frame, each side of said frame having a flange, said support means including a block member slidably supported on each of said flanges, and adjustment means supported in said frame and engaging said block members to cause said support members to be slid on said flanges through said block members to vary the position of said support members relative to said guide members to vary the position of said folding blades relative to one another.

2. The apparatus of claim 1 wherein a locking means is mounted on said frame to prevent said block from sliding in said flanges.

3. The apparatus of claim 2 wherein said locking means includes a support member mounted on said frame and a screw means projecting therethrough to exert pressure on said sliding block.

* * * * *